US006983241B2

(12) United States Patent
Mittal et al.

(10) Patent No.: US 6,983,241 B2
(45) Date of Patent: Jan. 3, 2006

(54) METHOD AND APPARATUS FOR PERFORMING HARMONIC NOISE WEIGHTING IN DIGITAL SPEECH CODERS

(75) Inventors: Udar Mittal, Hoffman Estates, IL (US); James P. Ashley, Naperville, IL (US)

(73) Assignee: Motorola, Inc., Schaumburg, IL (US)

( * ) Notice: Subject to any disclaimer, the term of this patent is extended or adjusted under 35 U.S.C. 154(b) by 46 days.

(21) Appl. No.: 10/965,462

(22) Filed: Oct. 14, 2004

(65) Prior Publication Data

US 2005/0096903 A1 May 5, 2005

Related U.S. Application Data

(60) Provisional application No. 60/515,581, filed on Oct. 30, 2003.

(51) Int. Cl.
*G10L 19/04* (2006.01)

(52) U.S. Cl. ..... 704/207; 704/211; 704/226

(58) Field of Classification Search ..... 704/200, 704/207, 209, 211, 219–221, 500, 226
See application file for complete search history.

(56) References Cited

U.S. PATENT DOCUMENTS 5,528,723 A 6/1996 Gerson et al.

*Primary Examiner*—Susan McFadden

(57) ABSTRACT

To address the need for choosing values of harmonic noise weighting (HNW) coefficient ($\epsilon_p$) so that the amount of harmonic noise weighting can be optimized, a method and apparatus for performing harmonic noise weighting in digital speech coders is provided herein. During operation, received speech is analyzed to determine a pitch period. HNW coefficients are then chosen based on the pitch period, and a perceptual noise weighting filter (C(z)) is determined based on the harmonic-noise weighting (HNW) coefficients ($\epsilon_p$).

8 Claims, 5 Drawing Sheets

100

—PRIOR ART—

200

—PRIOR ART—

300

300

METHOD AND APPARATUS FOR PERFORMING HARMONIC NOISE WEIGHTING IN DIGITAL SPEECH CODERS

CROSS-REFERENCE TO RELATED APPLICATIONS

This application claims the benefit of U.S. Provisional Application No. 60/515,581 filed Oct. 30, 2003, which is herein incorporated by reference.

FIELD OF THE INVENTION

The present invention relates, in general, to signal compression systems and, more particularly, to Code Excited Linear Prediction (CELP)-type speech coding systems.

BACKGROUND OF THE INVENTION

Compression of digital speech and audio signals is well known. Compression is generally required to efficiently transmit signals over a communications channel, or to store compressed signals on a digital media device, such as a solid-state memory device or computer hard disk. Although there exist many compression (or "coding") techniques, one method that has remained very popular for digital speech coding is known as Code Excited Linear Prediction (CELP), which is one of a family of "analysis-by-synthesis" coding algorithms. Analysis-by-synthesis generally refers to a coding process by which parameters of a digital model are used to synthesize a set of candidate signals that are compared to an input signal and analyzed for distortion. The set of parameters that yield the lowest distortion, or error component, is then either transmitted or stored. The set of parameters are eventually used to reconstruct an estimate of the original input signal. CELP is a particular analysis-by-synthesis method that uses one or more excitation codebooks that essentially comprise sets of code-vectors that are retrieved from the codebook in response to a codebook index. These code-vectors are used as stimuli to the speech synthesizer in a "trial and error" process in which an error criterion is evaluated for each of the candidate code-vectors, and the candidates resulting in the lowest error are selected.

For example, FIG. 1 is a block diagram of prior-art CELP encoder 100. In CELP encoder 100, an input signal comprising speech sample n (s(n)) is applied to a Linear Predictive Coding (LPC) analysis block 101, where linear predictive coding is used to estimate a short-term spectral envelope. The resulting spectral parameters (or LP parameters) are denoted by the transfer function A(z). The spectral parameters are applied to LPC Quantization block 102 that quantizes the spectral parameters to produce quantized spectral parameters $A_q$ that are suitable for use in a multiplexer 108. The quantized spectral parameters $A_q$ are then conveyed to multiplexer 108, and the multiplexer produces a coded bit stream based on the quantized spectral parameters and a set of parameters, $\tau$, $\beta$, k, and $\gamma$, that are determined by a squared error minimization/parameter quantization block 107. As one of ordinary skill in the art will recognize, $\tau$, $\beta$, k, and $\gamma$ are defined as the closed loop pitch delay, adaptive codebook gain, fixed codebook vector index, and fixed codebook gain, respectively.

The quantized spectral, or LP, parameters are also conveyed locally to LPC synthesis filter 105 that has a corresponding transfer function $1/A_q(z)$. LPC synthesis filter 105 also receives combined excitation signal u(n) from first combiner 110 and produces an estimate of the input signal $\hat{s}(n)$ based on the quantized spectral parameters $A_q$ and the combined excitation signal u(n). Combined excitation signal u(n) is produced as follows. An adaptive codebook code-vector $C_{96}$ is selected from adaptive codebook (ACB) 103 based on the index parameter $\tau$. The adaptive codebook code-vector $c_\tau$ is then weighted based on the gain parameter $\beta$ and the weighted adaptive codebook code-vector is conveyed to first combiner 110. A fixed codebook code-vector $c_k$ is selected from fixed codebook (FCB) 104 based on the index parameter k. The fixed codebook code-vector $c_k$ is then weighted based on the gain parameter $\gamma$ and is also conveyed to first combiner 110. First combiner 110 then produces combined excitation signal u(n) by combining the weighted version of adaptive codebook code-vector $c_\tau$ with the weighted version of fixed codebook code-vector $c_k$. (For the convenience of the reader, the variables are also given in terms of their z-transforms. The z-transform of a variable is represented by a corresponding capital letter, for example z-transform of e(n) is represented as E(z)).

LPC synthesis filter 105 conveys the input signal estimate $\hat{s}(n)$ to second combiner 112. Second combiner 112 also receives input signal s(n) and subtracts the estimate of the input signal $\hat{s}(n)$ from the input signal s(n). The difference between input signal s(n) and input signal estimate $\hat{s}(n)$ is applied to a perceptual error weighting filter 106, which produces a perceptually weighted error signal e(n) based on the difference between $\hat{s}(n)$ and s(n) and a weighting function w(n), such that $$E(z)=W(z)(S(z)-\hat{S}(z)) \tag{1}$$

Perceptually weighted error signal e(n) is then conveyed to squared error minimization/parameter quantization block 107. Squared error minimization/parameter quantization block 107 uses the error signal e(n) to determine an optimal set of parameters $\tau$, $\beta$, k, and $\gamma$ that produce the best estimate $\hat{s}(n)$ of the input signal s(n).

FIG. 2 is a block diagram of prior-art decoder 200 that receives transmissions from encoder 100. As one of ordinary skilled in the art realizes, the coded bit stream produced by encoder 100 is used by a de-multiplexer in decoder 200 to decode the optimal set of parameters, that is, $\tau$, $\beta$, k, and $\gamma$, in a process that is identical to the synthesis process performed by encoder 100. Thus, if the coded bit stream produced by encoder 100 is received by decoder 200 without errors, the speech $\hat{s}(n)$ output by decoder 200 can be reconstructed as an exact duplicate of the input speech estimate $\hat{s}(n)$ produced by encoder 100.

Returning to FIG. 1, weighting filter W(z) utilizes the frequency masking property of the human ear, such that simultaneously occurring noise is masked by the stronger signal provided the frequencies of the signal and the noise are close. As described in Salami R., Laflamme C., Adoul J-P, Massaloux D., "A toll quality 8 Kb/s speech coder for personal communications system," *IEEE Trans. On Vehicular Technology*, pp. 808–816, August 1994 W(z) is derived from the LPC coefficients $\alpha_i$, and is given by $$W(z)=\frac{A(z/\gamma_1)}{A(z/\gamma_2)} \quad 0<\gamma_2<\gamma_1\leq 1, \tag{2}$$

where $$a(Z)=1+\sum_{i=1}^{P} a_i z^{-i}, \tag{3}$$

and p is the order of the LPC. Since the weighting filter is derived from LPC spectrum, it is also referred to as "spectral weighting".

The above-described procedure does not take into account the fact that the signal periodicity also contributes to the spectral peaks at the fundamental frequencies and at the multiples of the fundamental frequencies. Various techniques have been proposed to utilize noise masking of these fundamental frequency harmonics. For example, in "Digital speech coder and method utilizing harmonic noise weighting" U.S. Pat. No. 5,528,723: Gerson and Jasiuk, and in Gerson I. A., Jasiuk M. A., "Techniques for improving the performance of CELP type speech coders," *Proc. IEEE ICASSP*, pp. 205–208, 1993, a method was proposed which includes harmonic noise masking in the weighting filter. As the above-references show, harmonic noise weighting is incorporated by modifying the spectral weighting filter by a harmonic noise weighting filter C(z) and is given by:

$$C(z) = 1 - \varepsilon_p \sum_{i=-M_1}^{M_2} b_i z^{-(D+i)}, \tag{4}$$

where D corresponds to the pitch period or the pitch lag or delay, $b_i$ are the filter coefficients and $0 \leqq \epsilon_p < 1$ is the harmonic noise weighting coefficient. The weighting filter incorporating harmonic noise weighting is given by:

$$W_H(z) = W(z)C(z). \tag{5}$$

The amount of harmonic noise weighting is typically dependent on the product $\epsilon_p b_i$. Since $b_i$ is dependent on the delay, the amount of harmonic noise weighting is a function of the delay. Prior-art references noted above have suggested that different values of harmonic noise weighting coefficient ($\epsilon_p$) can be used at different predetermined times: i.e., $\epsilon_p$ may be a time varying parameter (for example be allowed to change from sub-frame to sub-frame), however, the prior art does not provide a method for choosing p. Therefore, a need exists for a method and apparatus for performing harmonic noise weighting in digital speech coders that optimally and dynamically determines appropriate values of $\epsilon_p$ so that the amount of harmonic noise weighting can be optimized. While prior-art references noted above have suggested that different values of the harmonic noise weighting coefficient ($\epsilon_p$) can be used at different times (e.g., $\epsilon_p$ may vary from sub-frame to sub-frame), the prior art does not provide a method for varying $\epsilon_p$ or suggest when or how such a method may be beneficial. Therefore, a need exists for a method and apparatus for performing harmonic noise weighting in digital speech coders that optimally and dynamically determines appropriate values of $\epsilon_p$ so that the overall perceptual weighting can be improved.

DESCRIPTION OF THE INVENTION

To address the need for choosing values of harmonic noise weighting (HNW) coefficient ($\epsilon_p$) so that the amount of harmonic noise weighting can be optimized, a method and apparatus for performing harmonic noise weighting in digital speech coders is provided herein. During operation, received speech is analyzed to determine a pitch period. HNW coefficients are then chosen based on the pitch period, and a perceptual noise weighting filter (C(z)) is determined based on the harmonic-noise weighting (HNW) coefficients ($\epsilon_p$). For large pitch periods (D), the peaks of the fundamental frequency harmonics are very close and hence the valleys between the adjacent harmonics may lie in the masking region of the adjoining peaks. Thus, there may be no need to have a strong harmonic noise weighting coefficient for larger values of D.

Because HNW coefficients are a function of pitch period, a better noise weighting can be performed and hence the speech distortions are less noticeable to the listeners.

The present invention encompasses a method for performing harmonic noise weighting in a digital speech coder. The method comprises the steps of receiving a speech input s(n) determining a pitch period (D) from the speech input, and determining a harmonic noise weighting coefficient $\epsilon_p$ based on the pitch period. A perceptual noise weighting function $W_H(z)$ is then determined based on the harmonic noise weighting coefficient.

The present invention additionally encompasses a method for performing harmonic noise weighting in a digital speech coder. The method comprises the steps of receiving a speech input s(n), determining a closed-loop pitch delay ($\tau$) from the speech input, and determining a harmonic noise weighting coefficient $\epsilon_p$ based on the closed-loop pitch delay. A perceptual noise weighting function $W_H(z)$ is then determined based on the harmonic noise weighting coefficient.

The present invention additionally encompasses an apparatus comprising pitch analysis circuitry having speech (s(n)) as an input and outputting a pitch period (D) based on the speech, a harmonic noise coefficient generator having D as an input and outputting a harmonic noise weighting coefficient ($\epsilon_p$) based on D, and a perceptual error weighting filter having $\epsilon_p$ as an input and utilizing $\epsilon_p$ to generate a weighted error signal e(n), wherein e(n) is based on a difference between s(n) and an estimate of s(n).

The present invention finally encompasses an apparatus comprising a harmonic noise coefficient generator having a closed-loop pitch delay ($\tau$) as an input and outputting a harmonic noise weighting coefficient ($\epsilon_p$) based on $\tau$, a perceptual error weighting filter having $\epsilon_p$ as an input and utilizing $\epsilon_p$ to generate a weighted error signal e(n), wherein e(n) is based on a difference between s(n) and an estimate of s(n).

Figure 1:
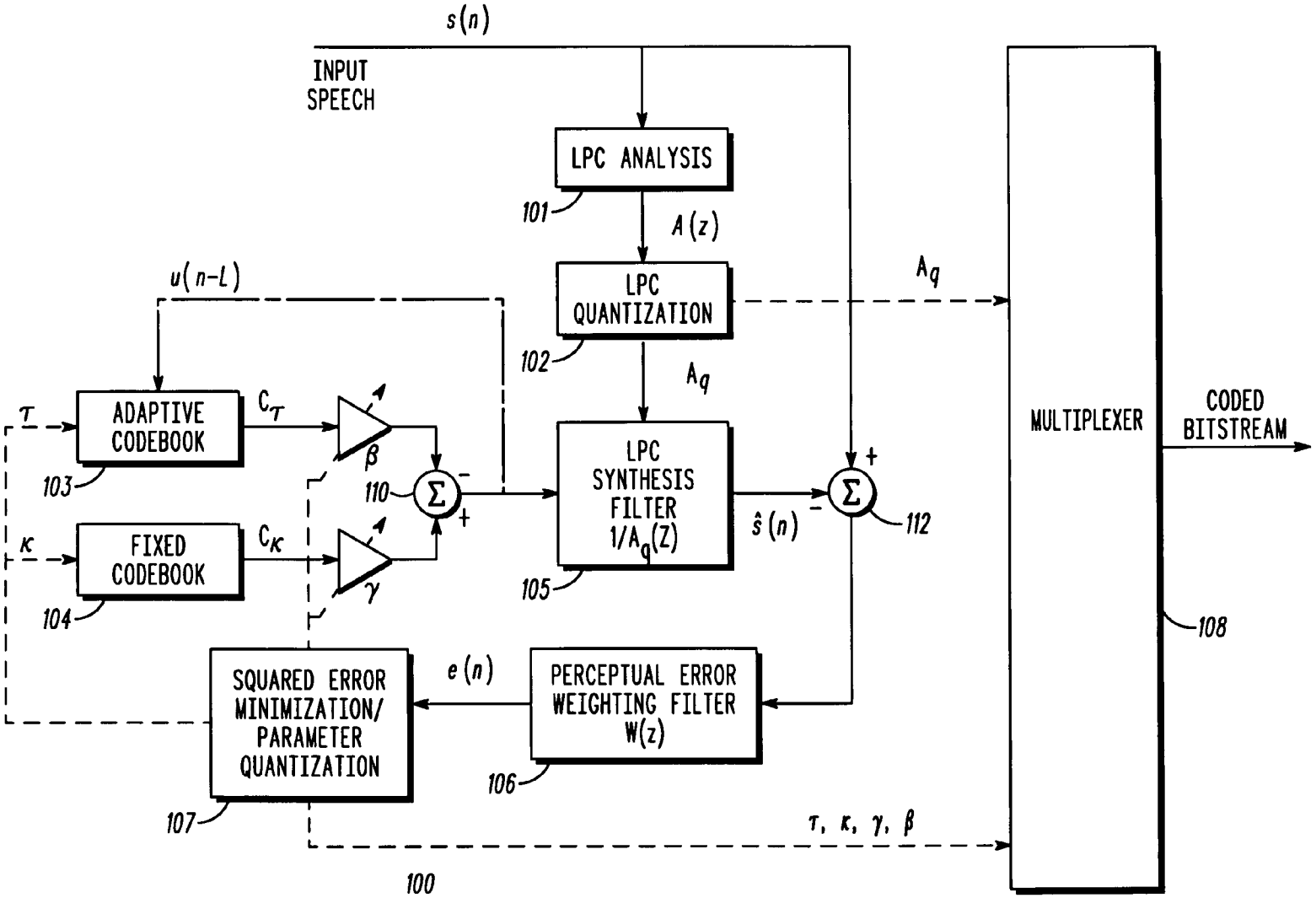
FIG. 1 is a block diagram of a prior-art Code Excited Linear Prediction (CELP) encoder.
Figure 2:
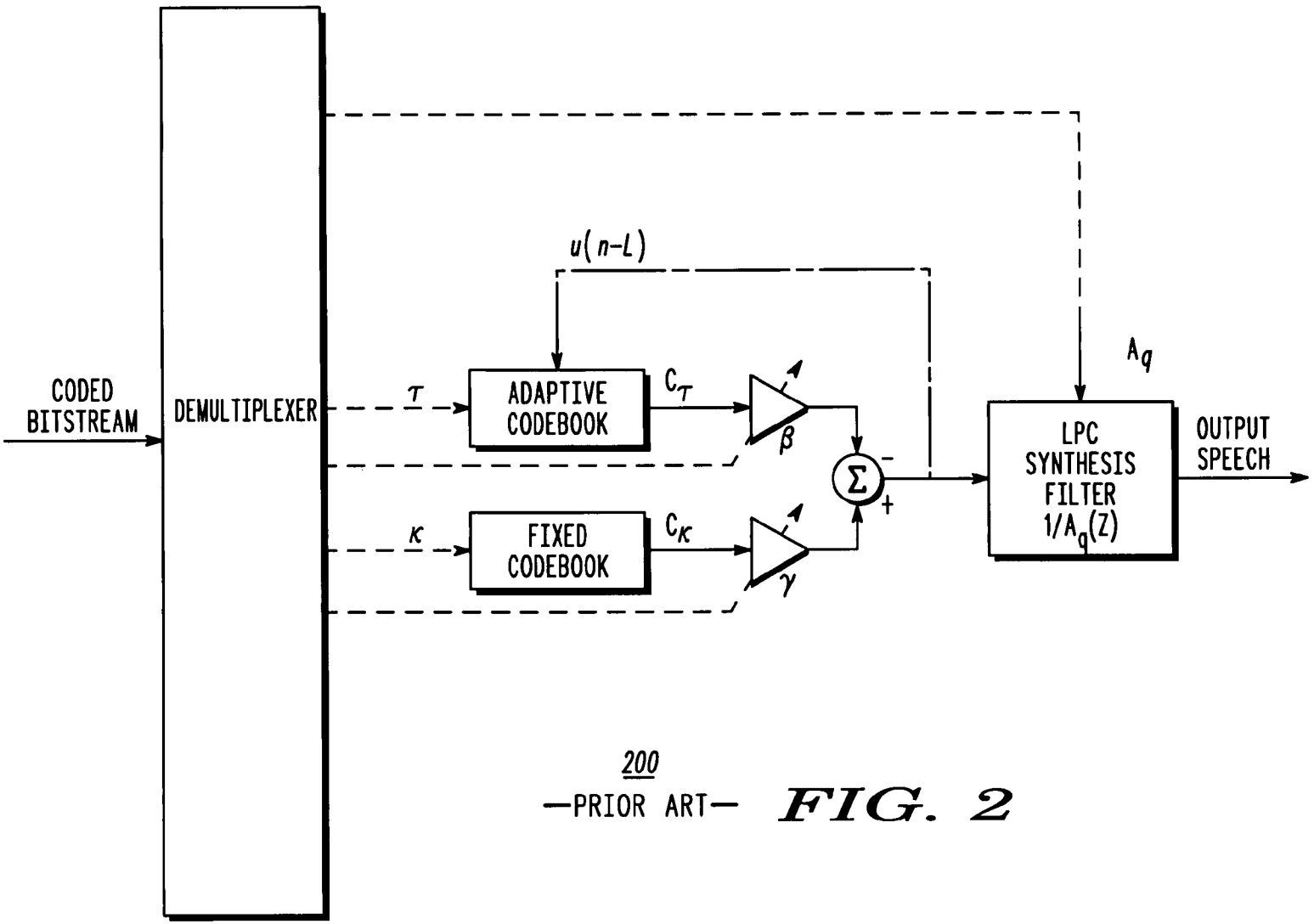
FIG. 2 is a block diagram of a prior-art CELP decoder of the prior art.
Figure 3:
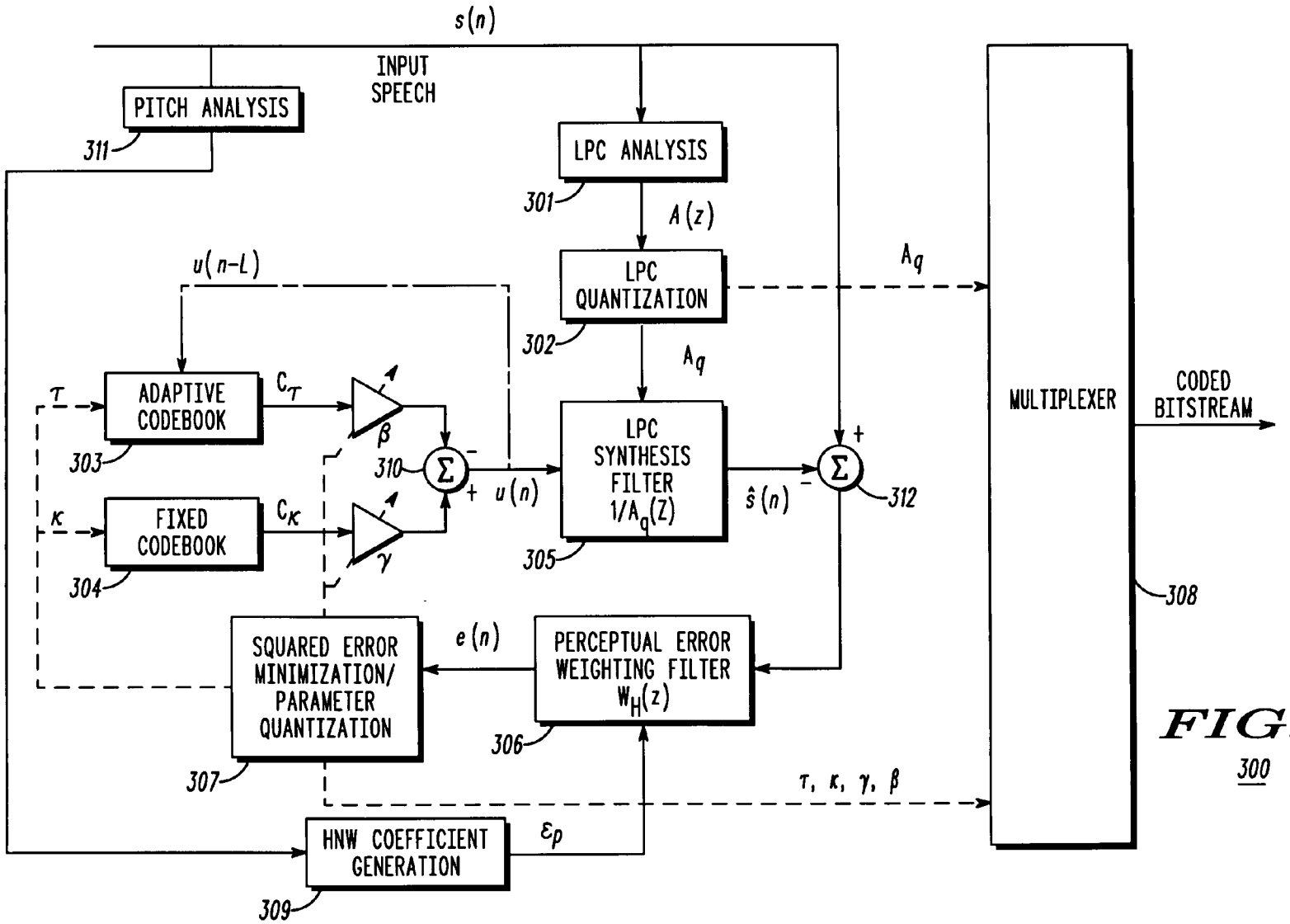
FIG. 3 is a block diagram of a CELP decoder in accordance with the preferred embodiment of the present invention.

Turning now to the drawings, wherein like numerals designate like components, FIG. 3 is a block diagram of CELP coder 300 in accordance with the preferred embodiment of the present invention. As shown, CELP decoder 300 is similar to those shown in the prior art, except for the addition of pitch analysis circuitry 311 and HNW coefficient generator 309. Additionally Perceptual Error weighting Filter 306 is adapted to receive HNW coefficients from HNW Coefficient generator 309. Operation of coder 300 occurs as follows:

Input speech s(n) is directed towards pitch analysis circuitry 311, where s(n) is analyzed to determine a pitch period (D). As one of ordinary skill in the art will recognize, pitch period (additionally referred to as pitch lag, delay, or pitch delay) is typically the time lag at which the past input speech has the maximum correlation with current input speech.

Once the pitch period (D) is determined, D is directed towards HNW coefficient generator 309 where a HNW coefficient ($\epsilon_p$) for the particular speech is determined. As discussed above, the harmonic noise weighting coefficient is allowed to dynamically vary as a function of the pitch period D. The harmonic noise-weighting filter is given by:

$$C(z) = 1 - \varepsilon_p(D) \sum_{i=-M_1}^{M_2} b_i z^{-(D+i)}. \tag{6}$$

Figure 4:
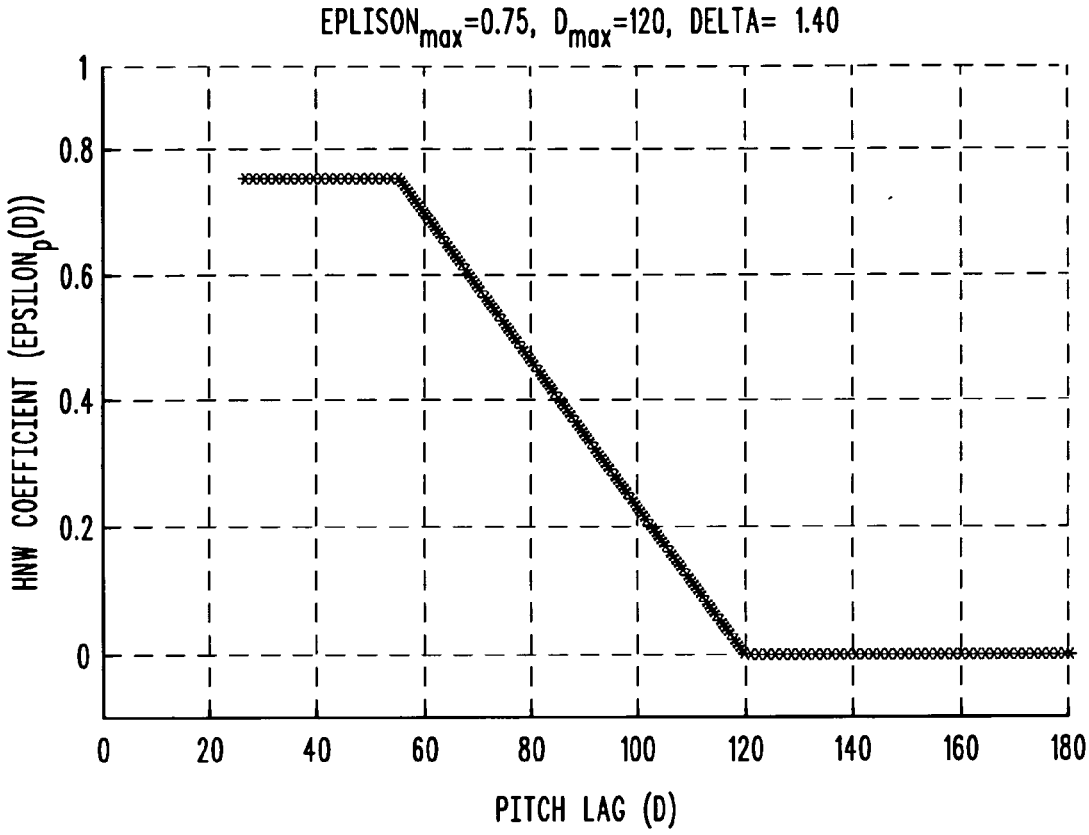
FIG. 4 is a graphical representation of $\epsilon_p$ versus pitch lag (D).

As mentioned above, it is desirable to have less harmonic noise weighting (C(z)) for larger value of D. Choosing $\epsilon_p$ as a decreasing function of D (see Eq. 7) ensures a lower amount of harmonic noise weighting for larger values of pitch delay. Although many functions of $\epsilon_p(D)$ exist, in the preferred embodiment of the present invention $\epsilon_p(D)$ is given by equation (7) and shown graphically in FIG. 4.

$$\varepsilon_p(D) = \begin{cases} \varepsilon_{\min}, & D \geq D_{\max} \\ \varepsilon_{\min} + \Delta \dfrac{(D_{\max} - D)}{D_{\max}}, & D \geq D_{\max}\left(1 - \dfrac{\varepsilon_{\max} - \varepsilon_{\min}}{\Delta}\right) \\ \varepsilon_{\max}, & \text{Otherwise} \end{cases}. \tag{7}$$

where, $\epsilon_{max}$ is the maximum allowable value of the harmonic noise weighting coefficient;

$\epsilon_{min}$ is the minimum allowable value of the harmonic noise weighting coefficient;

$D_{max}$ is the maximum pitch period above which the harmonic noise weighting coefficient is set to $\epsilon_{min}$;

$\Delta$ is the slope for the harmonic noise weighting coefficient.

Once $\epsilon_p(D)$ is determined by generator 309, $\epsilon_p(D)$ is supplied to filter 306 to generate the weighting filter $W_H(z)$. As described above, $W_H(z)$ is the product of W(z) and C(z). The error s(n)−ŝ(n) is supplied to weighting filter 306 to generate the weighted error signal e(n). As in prior-art encoders, error weighting filter 306 produces the weighted error signal e(n) based on a difference between the input signal and the estimated input signal, that is:

$$E(z) = W_H(z)(S(Z) - \hat{S}(z)). \tag{8}$$

Weighting filter $W_H(z)$ utilizes the frequency masking property of the human ear, such that simultaneously occurring noise is masked by the stronger signal provided the frequencies of the signal and the noise are close. Based on the value of e(n), squared Error Minimization/Parameter Quantization circuitry 307 produces values of $\tau$, k, $\gamma$, $\beta$ which are transmitted on the channel, or stored on a digital media device.

As discussed above, because HNW coefficients are a function of pitch period, a better noise weighting can be performed and hence the speech distortions are less noticeable to the listener.

Figure 5:
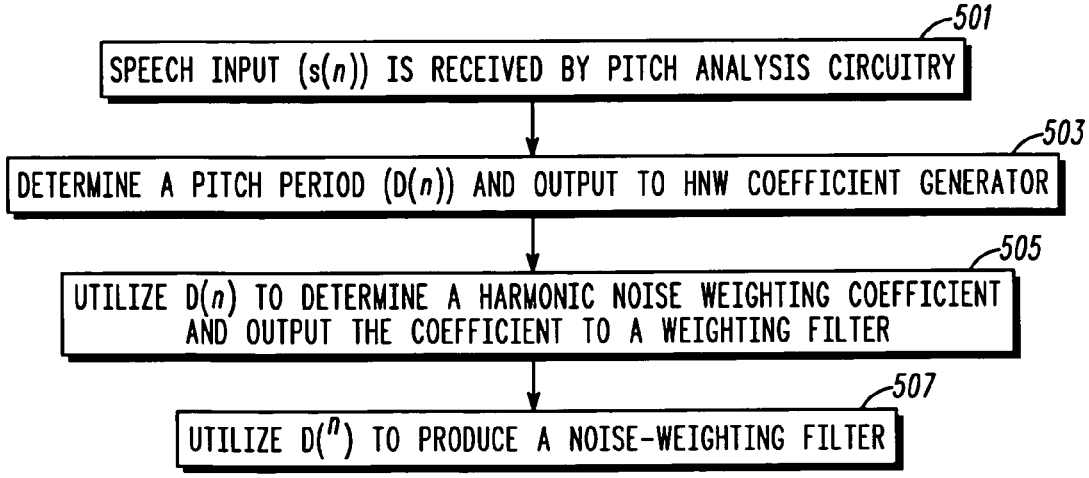
FIG. 5 is a flow chart showing steps executed by a CELP encoder to include the Harmonic Noise Weighting method of the current invention.

FIG. 5 is a flow chart showing operation of encoder 300. The logic flow begins at step 501 where a speech input (s(n)) is received by pitch analysis circuitry 311. At step 503, pitch analysis circuitry 311 determines a pitch period (D) and outputs D to HNW coefficient generator 309. HNW coefficient generator 309 utilizes D to determine a harmonic noise weighting coefficient ($\epsilon_p$) based on D and outputs $\epsilon_p$ to perceptual error weighting filter 306 (step 505). Finally, at step 507 filter 306 utilizes $\epsilon_p$ to produce a perceptual noise weighting function $W_H(z)$.

Figure 6:
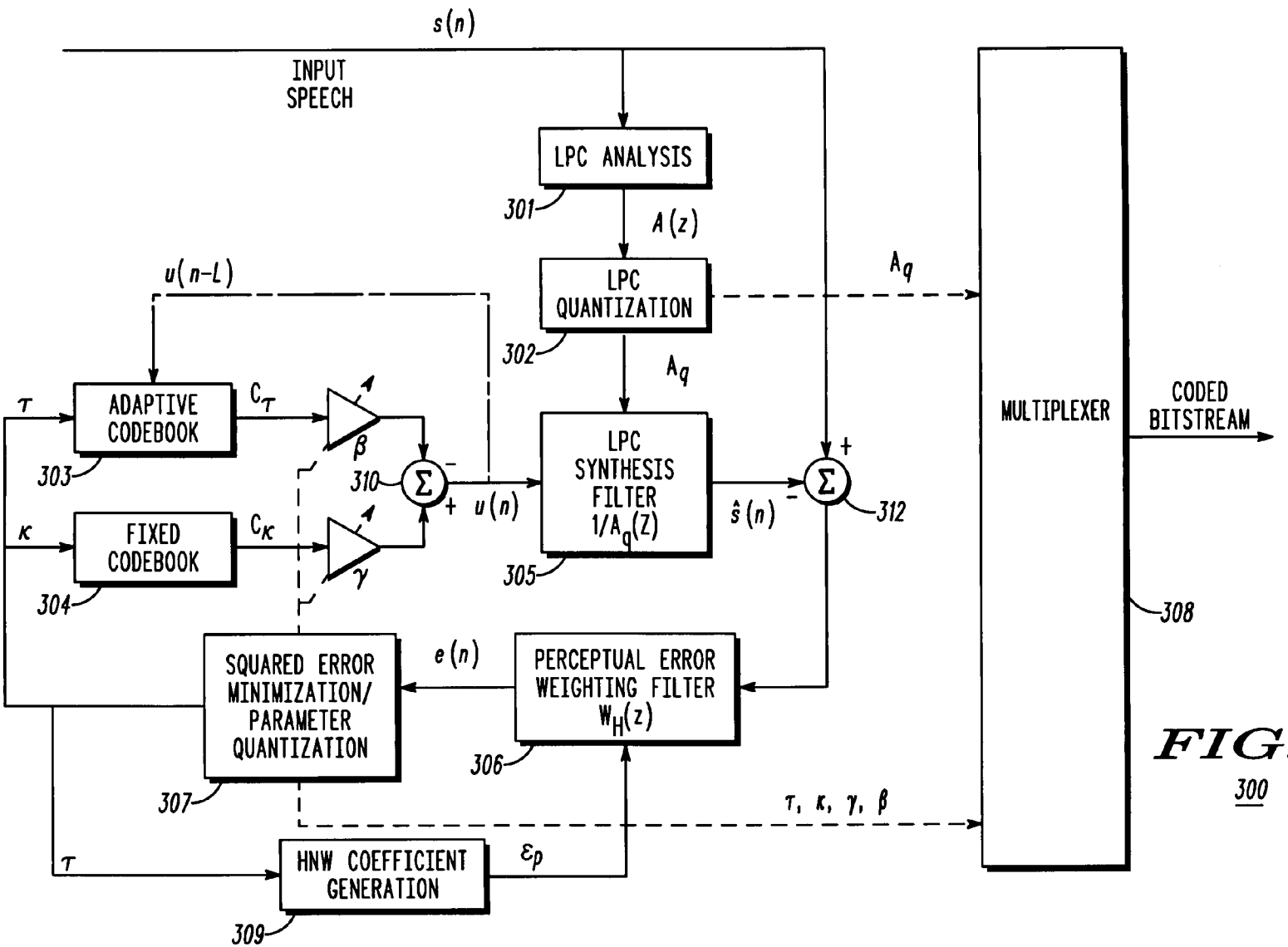
FIG. 6 is a block diagram of a CELP encoder in accordance with an alternate embodiment of the present invention.

While the invention has been particularly shown and described with reference to a particular embodiment, it will be understood by those skilled in the art that various changes in form and details may be made therein without departing from the spirit and scope of the invention. For example, although a specific formula was given for the production of $W_H(z)$ from $\epsilon_p$ it is intended that other means for producing $W_H(z)$ from $\epsilon_p$ may be utilized. For example, the summation term in the definition of C(z) in equation (6) can be further modified before multiplying with $\epsilon_p$. Additionally, in an alternate embodiment $\epsilon_p$ can be based on $\tau$, with $\tau$ (see FIG. 6) replacing D in equation (7). As discussed above $\tau$ is defined as the closed loop pitch delay, with $\epsilon_p$ being a decreasing function of $\tau$. Thus, equation (7) becomes:

$$\varepsilon_p(\tau) = \begin{cases} \varepsilon_{\min}, & \tau \geq \tau_{\max} \\ \varepsilon_{\min} + \Delta \dfrac{(\tau_{\max} - \tau)}{\tau_{\max}}, & \tau \geq \tau_{\max}\left(1 - \dfrac{\varepsilon_{\max} - \varepsilon_{\min}}{\Delta}\right) \\ \varepsilon_{\max}, & \text{Otherwise} \end{cases}. \tag{9}$$

where, $\epsilon_{max}$ is the maximum allowable value of the harmonic noise weighting coefficient;

$\epsilon_{min}$ is the minimum allowable value of the harmonic noise weighting coefficient;

$\tau_{max}$ is the maximum closed-loop pitch delay above which harmonic noise weighting coefficient is set to $\epsilon_{min}$;

$\Delta$ is the slope for the harmonic noise weighting coefficient.

What is claimed is:

1. A method for performing harmonic noise weighting in a digital speech coder, the method comprising the steps of:

receiving a speech input s(n);

determining a pitch period (D) from the speech input;

determining a harmonic noise weighting coefficient $\epsilon_p$ based on the pitch period;

determining a perceptual noise weighting function $W_H(z)$ based on the harmonic noise weighting coefficient; and transmitting a coded bit stream representing the speech input based on the perceptual noise weighting function.

2. The method of claim 1 wherein $\epsilon_p$ is a decreasing function of D.

3. The method of claim 2 wherein:

$$\varepsilon_p(D) = \begin{cases} \varepsilon_{\min}, & D \geq D_{\max} \\ \varepsilon_{\min} + \Delta \dfrac{(D_{\max} - D)}{D_{\max}}, & D \geq D_{\max}\left(1 - \dfrac{\varepsilon_{\max} - \varepsilon_{\min}}{\Delta}\right), \\ \varepsilon_{\max}, & \text{Otherwise} \end{cases}$$

where $\epsilon_{max}$ is a maximum allowable value of the harmonic noise weighting coefficient;

$\epsilon_{min}$ is a minimum allowable value of the harmonic noise weighting coefficient;

$D_{max}$ is a maximum pitch period above which harmonic noise weighting coefficient is set to $\epsilon_{min}$; and $\Delta$ is the slope for the harmonic noise weighting coefficient.

4. A method for performing harmonic noise weighting in a digital speech coder, the method comprising the steps of:

receiving a speech input s(n);

determining a closed-loop pitch delay ($\tau$) from the speech input;

determining a harmonic noise weighting coefficient $\epsilon_p$ based on the closed-loop pitch delay;

determining a perceptual noise weighting function $W_H(z)$ based on the harmonic noise weighting coefficient; and transmitting a coded bit stream representing the speech input based on the perceptual noise weighting function.

5. The method of claim 4 wherein $\epsilon_p$ is a decreasing function of $\tau$

6. The method of claim 5 wherein:

$$\varepsilon_p(\tau) = \begin{cases} \varepsilon_{\min}, & \tau \geq \tau_{\max} \\ \varepsilon_{\min} + \Delta \dfrac{(\tau_{\max} - \tau)}{\tau_{\max}}, & \tau \geq \tau_{\max}\left(1 - \dfrac{\varepsilon_{\max} - \varepsilon_{\min}}{\Delta}\right) \\ \varepsilon_{\max}, & \text{Otherwise} \end{cases}$$

where, $\epsilon_{max}$ is a maximum allowable value of the harmonic noise weighting coefficient;

$\epsilon_{min}$ is a minimum allowable value of the harmonic noise weighting coefficient;

$\tau_{max}$ is a maximum closed-loop pitch delay above which harmonic noise weighting coefficient is set to $\epsilon_{min}$; and $\Delta$ is the slope for the harmonic noise weighting coefficient.

7. An apparatus comprising:

pitch analysis circuitry having speech (s(n)) as an input and outputting a pitch period (D) based on the speech;

a harmonic noise coefficient generator receiving D from the pitch analysis circuitry and outputting a harmonic noise weighting coefficient ($\epsilon_p$) based on (D); and a perceptual error weighting filter receiving $\epsilon_p$ from the harmonic noise coefficient generator and utilizing $\epsilon_p$ to generate a weighted error signal e(n), wherein e(n)is based on a difference between s(n) and an estimate of s(n).

8. An apparatus comprising:

a harmonic noise coefficient generator having a closed-loop pitch delay ($\tau$) as an input and outputting a harmonic noise weighting coefficient ($\epsilon_p$) based on $\tau$, and a perceptual error weighting filter receiving $\epsilon_p$ from the harmonic noise coefficient generator and utilizing $\epsilon_p$ to generate a weighted error signal e(n), wherein e(n) in based on a difference between s(n) and an estimate of s(n).

* * * * *